US005488976A

United States Patent [19]

Lorenz et al.

[11] Patent Number: 5,488,976

[45] Date of Patent: Feb. 6, 1996

[54] COIL SEAM FOR SINGLE LAYER INDUSTRIAL FABRICS HAVING AN UNEVEN SHED PATTERN

[75] Inventors: Michelle M. Lorenz, Appleton; Cynthia A. Houfek, Menasha, both of Wis.

[73] Assignee: Asten, Inc., Charleston, S.C.

[21] Appl. No.: 214,784

[22] Filed: Mar. 16, 1994

[51] Int. Cl.[6] ..... D03D 13/00; D03D 15/00

[52] U.S. Cl. ..... 139/383 AA; 428/58

[58] Field of Search ..... 139/383 AA; 428/58

[56] References Cited

U.S. PATENT DOCUMENTS

| | | | |
|---|---|---|---|
| 3,060,547 | 10/1962 | MacBean | 139/383 AA |
| 3,622,415 | 11/1971 | Kunsman | 139/383 AA X |
| 4,026,331 | 5/1977 | Lees et al. . | |
| 4,862,926 | 9/1989 | Barrette et al. . | |
| 4,883,096 | 11/1989 | Penven . | |
| 4,938,269 | 7/1990 | Nicholas et al. | 139/383 AA |
| 4,976,293 | 12/1990 | Aldrich . | |
| 4,991,630 | 2/1991 | Penven | 139/383 AA |
| 5,089,324 | 2/1992 | Jackson | 139/383 AA X |
| 5,117,542 | 6/1992 | Krenkel et al. | 139/383 AA X |
| 5,148,838 | 9/1992 | Lee | 139/383 AA |
| 5,188,884 | 2/1993 | Smith . | |

*Primary Examiner*—Andy Falik
*Attorney, Agent, or Firm*—Volpe and Koenig

[57] ABSTRACT

A seam construction for joining the ends of an industrial fabric. The fabric having machine direction and cross machine direction yarns interwoven in an uneven shed pattern that defines a single layer fabric body. The machine direction yarns at each end define a series of loops that secure a respective coil seam member to each end of the fabric. The machine direction yarns of the fabric are woven in a repeated pattern having "n" yarns, wherein "n" is an uneven number and "(n−1)÷2" machine direction yarns are woven back into the body of the fabric in a shed pattern defined by another machine direction yarn and the "$n^{th}$" yarn is woven back into the body of the fabric in its identical shed pattern.

2 Claims, 5 Drawing Sheets

FIG. 9
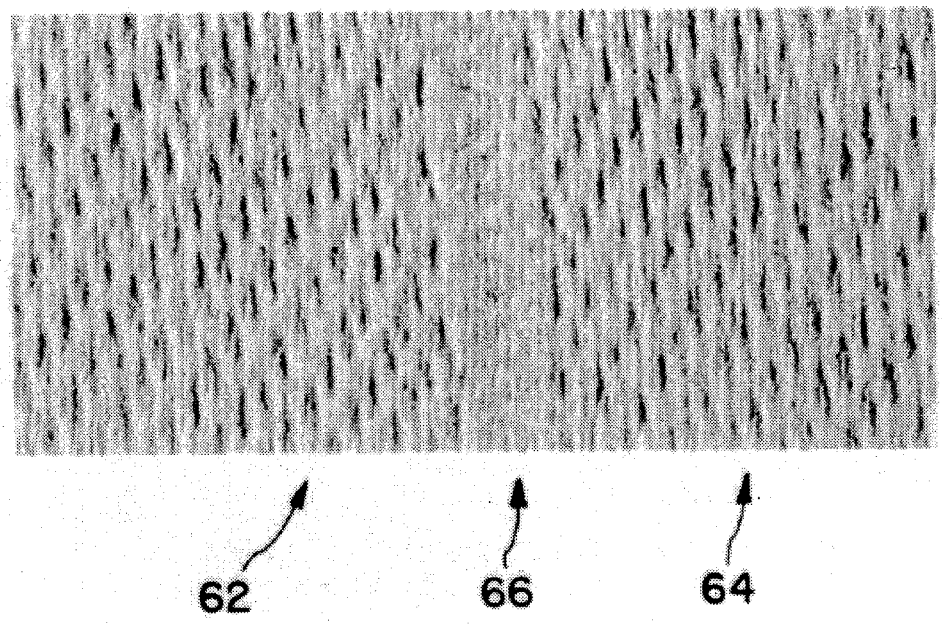
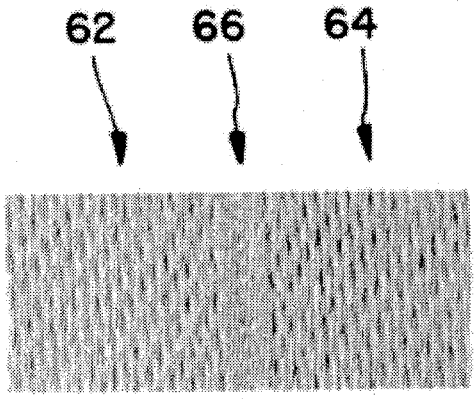
FIG. 8
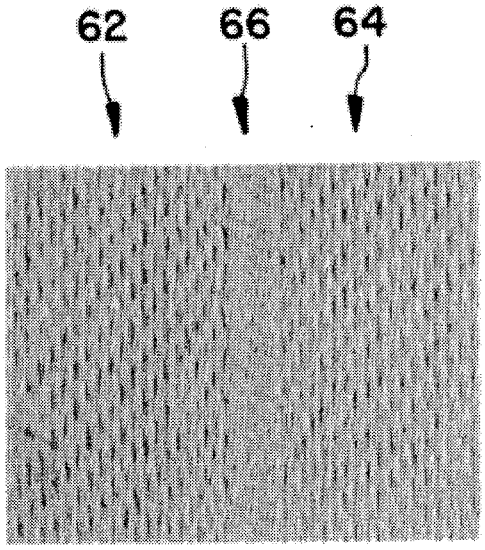
FIG. 7

COIL SEAM FOR SINGLE LAYER INDUSTRIAL FABRICS HAVING AN UNEVEN SHED PATTERN

BACKGROUND OF THE INVENTION

1. Field of the Invention

The present invention relates to a seam construction for an industrial fabric, in general, and, in particular, to a seam construction for a single layer industrial fabric having an uneven shed pattern. Most particularly, it relates to a papermaker's forming fabric in the described construction.

2. Prior Art

The prior art has recognized for some time the advantages to be achieved in seaming a woven fabric to form an endless belt for use in industrial process such as papermaking. In the dryer and press sections of the papermaking machines, it has long been accepted practice to seam the fabric. More recently, the papermaking art has been attempting to produce acceptable seams in forming fabrics.

Various seam constructions will be known to those skilled in the art. One type of known seam is the clipper hook seam. In this type of seam, the clipper hooks, generally of stiff wire, are crimped to each end of the fabric and the eyes on the ends of the fabric are meshed together and a cable inserted to complete the seam. Another known seam is the multifilament seam. In this seam, multifilament yarn connecting loops are woven into a webbing that has been sewed to the fabric body. Another known seam is the pin seam. In this construction, connecting loops of machine direction monofilament yarns are woven back into the fabric body. Generally, the back woven yarns are woven to complement the weave pattern of the fabric body. The loops are intermeshed and joined as a seam by a monofilament connecting pin or pintle. Another known seam is the spiral seam. This seam is generally formed of all plastic materials. Loops of a continuous spiral are affixed to either end of the fabric; the loops are intermeshed and interconnected with a pintle wire to form the seam.

Regardless of the seam construction utilized, it has been recognized by the art that the seam characteristics are critical to the performance of a papermaker's fabric. Likewise, it has been recognized that the seam must resemble the body of the fabric as closely as possible. In addition, the seam must be uniform and generally share the sheet forming characteristics of the body of the fabric. Although certain applications may be more tolerant of seam constructions, which may cause marks on the product, it is almost always desirable to minimize the differences between the seam and the fabric body.

In papermaking, seam construction has long been recognized as critical. As higher speeds are attained in the papermaking machine, the seam has become increasingly critical. In addition to increased speed, the desire for reduced fabric caliper has lead to additional pressures for a generally uniform seam within a reduced fabric plane. In addition to the need for uniform seams in higher speed and lower caliper fabrics, seam durability is critical to the operation of and the durability of the fabric in production.

Although a number of the above seams have been successful, there are some remaining limitations in the prior art seam constructions. Generally, as the fabric thickness or caliper is reduced, the thickness of the seam must be reduced. This becomes especially critical in single layer fabrics. The desire for reduced seam caliper has lead to an associated reduction in the caliper of the seaming elements.

However, in single layer fabrics, - the pintle element has been reduced to the lower limits of acceptability. This has resulted in premature seam failure which renders an otherwise useful fabric unproductive. The problems in single layer fabrics have been especially difficult in single layer fabrics with uneven sheds., i.e. three, five, seven, etc. shed fabrics. Earlier attempts to seam such fabrics in papermaking applications have resulted in a defect known as a pin hole.

In view of the above, it is the general object of the present invention to provide an improved seam construction that is especially useful for lower caliper, single layer industrial fabrics having uneven shed patterns. In particular, it is an object of this invention to provide a coil seam construction for single layer fabrics, woven in odd shed repeats, for use in paper forming applications where minimal seam marking is acceptable.

SUMMARY OF THE INVENTION

The present invention provides a coil seam construction which is especially useful for joining the ends of a single layer fabric, woven in an odd shed repeat. In all instances, the maximum caliper of the seam will not exceed the body caliper of the papermaker's fabric being joined by more than forty percent of fabric body. The preferred seam of the present invention is constructed by attaching coil seaming elements, as described in U.S. Pat. No. 4,862,926 which is commonly assigned with the present invention, to each end of the fabric. The spiral seaming elements are preferably attached by back weaving machine direction yarns in what is commonly referred to as a pin seam back weave construction. For a shed repeat of "n" yarns, (n−1)÷2 yarns are backwoven in a shed pattern associated with another yarn and the "$n^{th}$" yarn is backwoven in its identical pattern.

BRIEF DESCRIPTION OF THE DRAWINGS

FIG. 7 is a photographic reproduction of an actual toweling sample which is wrapped about a roller having a three inch diameter.

FIG. 8 is a photographic reproduction of a sample of the toweling shown in FIG. 7 which has been treated with graphite shavings to highlight the patterns thereon.

FIG. 9 is a double size photographic reproduction of the sample in FIG. 8.

DETAILED DESCRIPTION OF THE INVENTION

The invention will be described in detail with reference to the various drawing figures. For the purposes of clarity and ease of understanding, the actual fabric body has not been illustrated in some of the drawings. Likewise, some of the drawings omit some repeating details for the sake of clarity.

Figure 1:
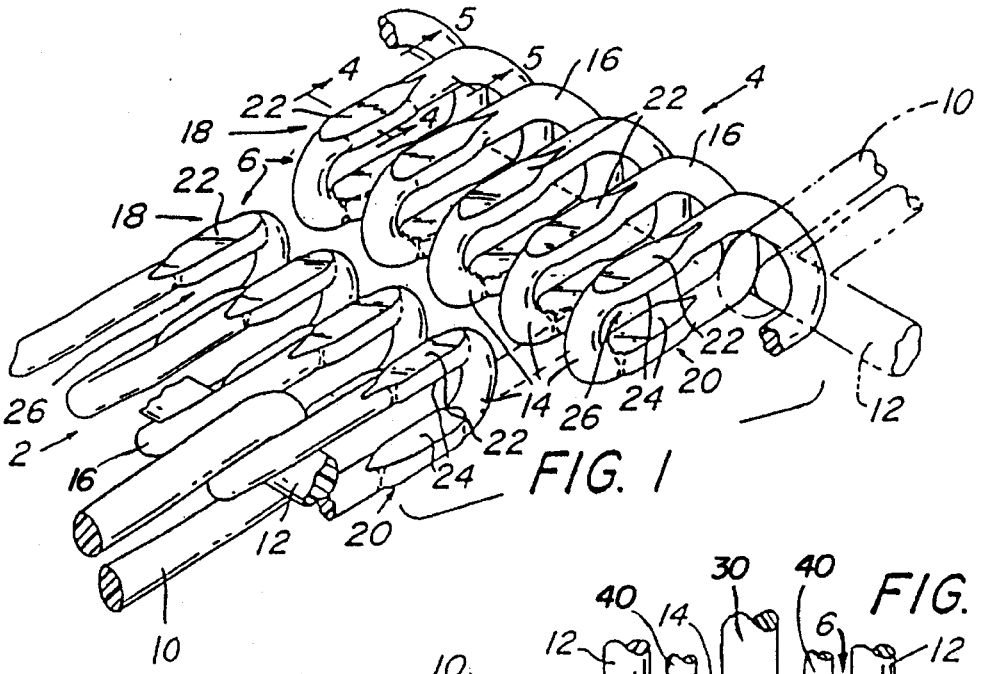
FIG. 1 illustrates, in a perspective view, a section of the coil members utilized in the seam construction according to the invention.

Referring to FIG. 1, there is illustrated a portion of the seam construction prior to closing of the seam. The fabric has two opposed ends, 2 and 4, each of which is provided with a coil member 6. In the illustration of FIG. 1, the coil members 6 are produced from continuous monofilament yarns. The yarns 10 and 12 in this configuration have a circular cross section. Each coil member 6 has a plurality of angular headcurves 16 and a plurality of vertical headcurves 14. The vertical headcurves 14 of each coil member 6 are spaced from each other by a sufficient distance to permit intermeshing with the headcurves of the opposite coil member. This configuration will be known to those skilled in the art.

Each of the angular headcurves 16 is spaced apart by a distance which is sufficient to permit a machine direction yarn 10 to be received between adjacent headcurves 16. It will be understood by those skilled in the art that the angular headcurves 16 are also angled in accordance with the space requirements between the adjacent vertical headcurves 14. Thus, the space between angular headcurves will have a minimum determined by the space requirements of the machine direction yarns 10 and a maximum determined by the space requirements of the vertical headcurves 14. On the upper or paper carrying surface of the seam, the angular headcurves and vertical headcurves are interconnected by upper or supporting winding legs 18. On the lower or running surface the headcurves are interconnected by the winding legs 20.

The winding legs 18 and 20 are generally parallel to each other and within the same vertical plane as the respective vertical headcurve 14. In the preferred embodiment, both the upper and lower winding legs are provided with exterior flat surfaces 22 and interior flat surfaces 24.

As a result of the interior flat surfaces 24, the spiral members 6 will define an interior void or channel 26 which has a greater distance between the interior flat surfaces 24 than would be available in a uniformly circular coil member without the flat surfaces 24. As a result of the flat surfaces 24, the pintle receiving channel which is defined by the intermeshed coil members 6, FIGS. 2 and 3, has a greater vertical dimension than would be available in a coil of the same uniformly sized monofilament without the flattened surfaces 24. As noted previously, it is preferred that the coil members 6 have flattened support surfaces 22. Spiral coils having flattened support surfaces usable with the present invention are disclosed in U.S. Pat. Nos. 4,606,792; 4,654,122; and 4,862,926.

With respect to attachment of the coil members to the fabric body, this attachment is accomplished with techniques utilized by the prior art to form pin or coil seams. Accordingly, it is only the differences in technique which will be explained at this time. In the conventional pin seam, one in four or two in four of the machine direction yarns is/are used to form the seaming loops. The coil seam of U.S. Pat. No. 4,862,926 utilizes two in four of the machine direction yarns to bind the coil members 6 to the fabric body. Generally, such seam constructions are only attempted in fabrics woven in even shed patterns, however, U.S. Pat. No. 5,188,884 does disclose one attempt to pin seam multilayer fabrics woven in uneven shed patterns. In the present invention, the machine direction yarns of the fabric body are woven in an uneven shed count., i.e. three, five, seven and etc. The machine direction yarns 10 do not form the seaming loops, as in a common pin seam, rather they form the binding loops, in the manner of U.S. Pat. No. 4,862,926, which secure the coil member to the fabric body. However, the seam construction of the present invention is strengthened through the utilization of more than half of the machine direction yarns from each repeat pattern. This increased use of machine direction yarns 10 is accomplished without any sacrifice in the quality of the seam.

Although it is possible to attach the coil member 6 to the fabric body solely through the use of yarns 10, it is preferred that a tying yarn or pintle 12 be inserted within and adjacent to the angular headcurves 16. With reference to FIG. 1, yarn 10 extends between the angular headcurves around the tying wire or pintle 12 and weaves back into the body of the fabric in the usual manner of a pin seam. As will be known to those skilled in the art, the end is woven back into the body of the fabric in the shed pattern of the end which it is replacing in the body of the fabric. Generally, this will be the next adjacent end and the weave pattern will be consistent with the overall pattern of the fabric body. In the preferred five shed fabric of the present invention, four of the five ends will be treated in this usual manner. However, the remaining end, the "$n^{th}$" yarn, is woven back into the fabric body adjacent to itself and in the same shed repeat. No other machine direction yarn is trimmed to make room for the weave back. In addition, the length of the weave back is only approximately twenty-five to thirty percent (25–30%) of the next shortest weave back. Although the "$n^{th}$" yarn in the repeat will not contribute equally to the seam strength with the remaining weave back yarns of the shed pattern, the "$n^{th}$" yarn still contributes more to seam strength and stabilization than the prior art constructions. Since the tying wire or pintle 12 is under increased machine direction yarn influence, unequal tensions at various points on the coil member 6 will be reduced. The attachment of the coil members and the weaving back into the fabric body of the machine direction yarns 10 forming the loops can be accomplished with any of the various shed forming apparatuses which are known to those skilled in the art.

As noted previously, some applications, such as towels, wipers and the like, will tolerate minimal seam marking. However, these applications will not tolerate uneven sheet formation or pin holes in the seam area. In view of the single layer nature of the fabric of the present invention and the low caliper of the seam, the tendency to develop pin holes is increased. In those applications where this is problematic, the problem may be resolved by inserting stuffer yarns into the seam area.

Figure 2:
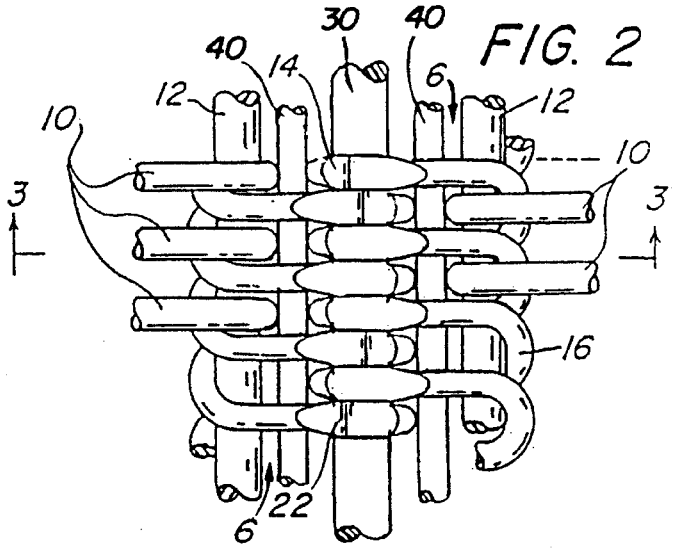
FIG. 2 illustrates, in a top plan view, a section of the seam construction with the coil members intermeshed and the pintle in place. This is illustrative of the final seam construction and includes stuffer yarns in the seam area.
Figure 3:
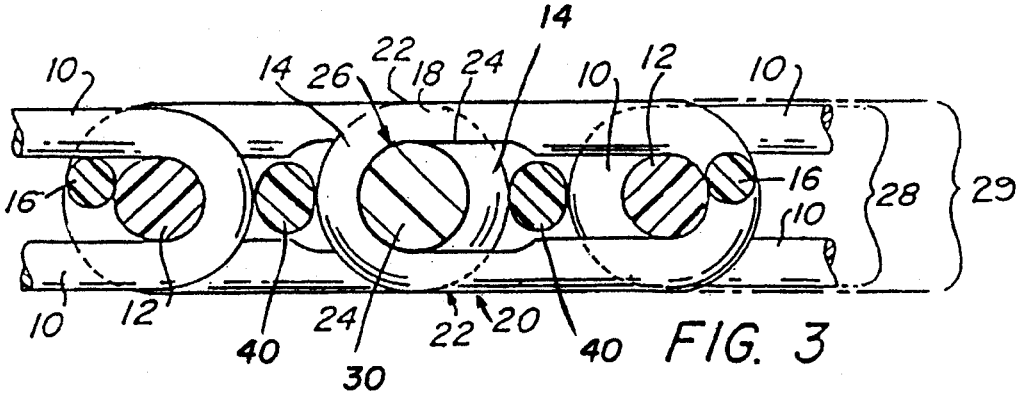
FIG. 3 is a section through the line 3—3 of FIG. 2 which illustrates the difference in caliper between the fabric body and the seam.

Reference is now made to FIGS. 2 and 3 which illustrate a closed seam of the present invention with stuffers. As can be seen in FIG. 2, the coil members 6 are intermeshed and channels 26 receive the pintle 30. In the preferred embodiment, the pintle 30 has a circular configuration, however, it may be non-circular or oval in configuration. As noted previously, some configurations will require stuffers in the seaming area to avoid the defect known as a pin hole. In FIGS. 2 and 3, the stuffers 40 are illustrated as being positioned in the seam between the head curves 14 and the machine direction yarns 10. Alternatively, an oval or an elliptical pintle as described in U.S. Pat. No. 4,862,926 may be used in the seam area. For many constructions, a circular pintle, such as 30, may be acceptable. As will be appreciated as those skilled in the art, the pintle configuration and the number of stuffers will be determined by the application.

Figure 4:
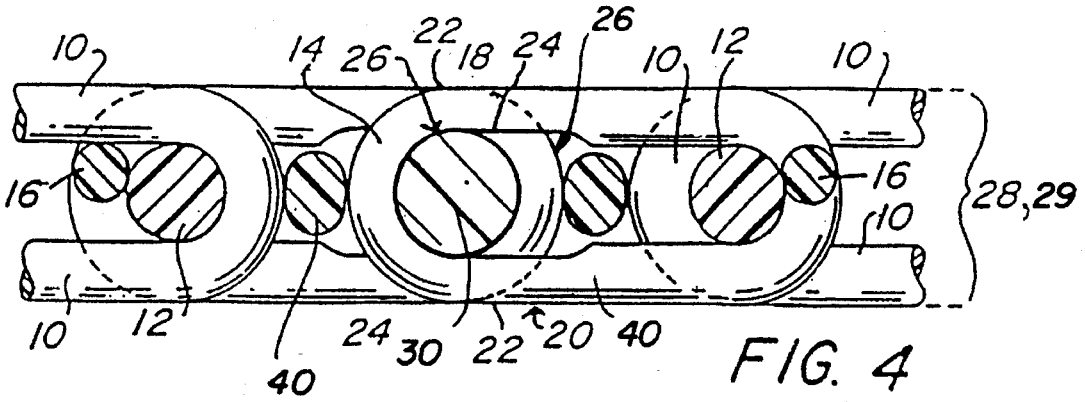
FIG. 4 is a section similar to that of FIG. 3 which illustrates seam construction of the same caliper as the fabric body.

FIGS. 3 and 4 illustrate two possible variations in the relationship between the fabric body caliper and the seam caliper. In FIG. 3, the fabric body, as indicated at 28, has a caliper which is less than the caliper of the seam, as indicated at 29. In a trial fabric which successfully employed a seam of the type illustrated in FIG. 3, the body of the fabric had a caliper of 0.0535 inches while the caliper of the seam was 0.0598 inches. This represents a seam caliper increase of about twelve percent (12%) over the body of the fabric. In another trial fabric, a seam without stuffers was successful with a fabric having a body caliper of 0.0363 inches and a seam caliper of 0.0495 inches. This represents a seam caliper which is about thirty-six percent (36%) greater than the body caliper. In general, it is expected that seam caliper should not exceed body caliper by more than forty percent (40%) and it is preferable to maintain the seam caliper increase below twenty percent (20%). In the configuration illustrated in FIG. 4, the seam and fabric body have the same caliper.

Figure 5:
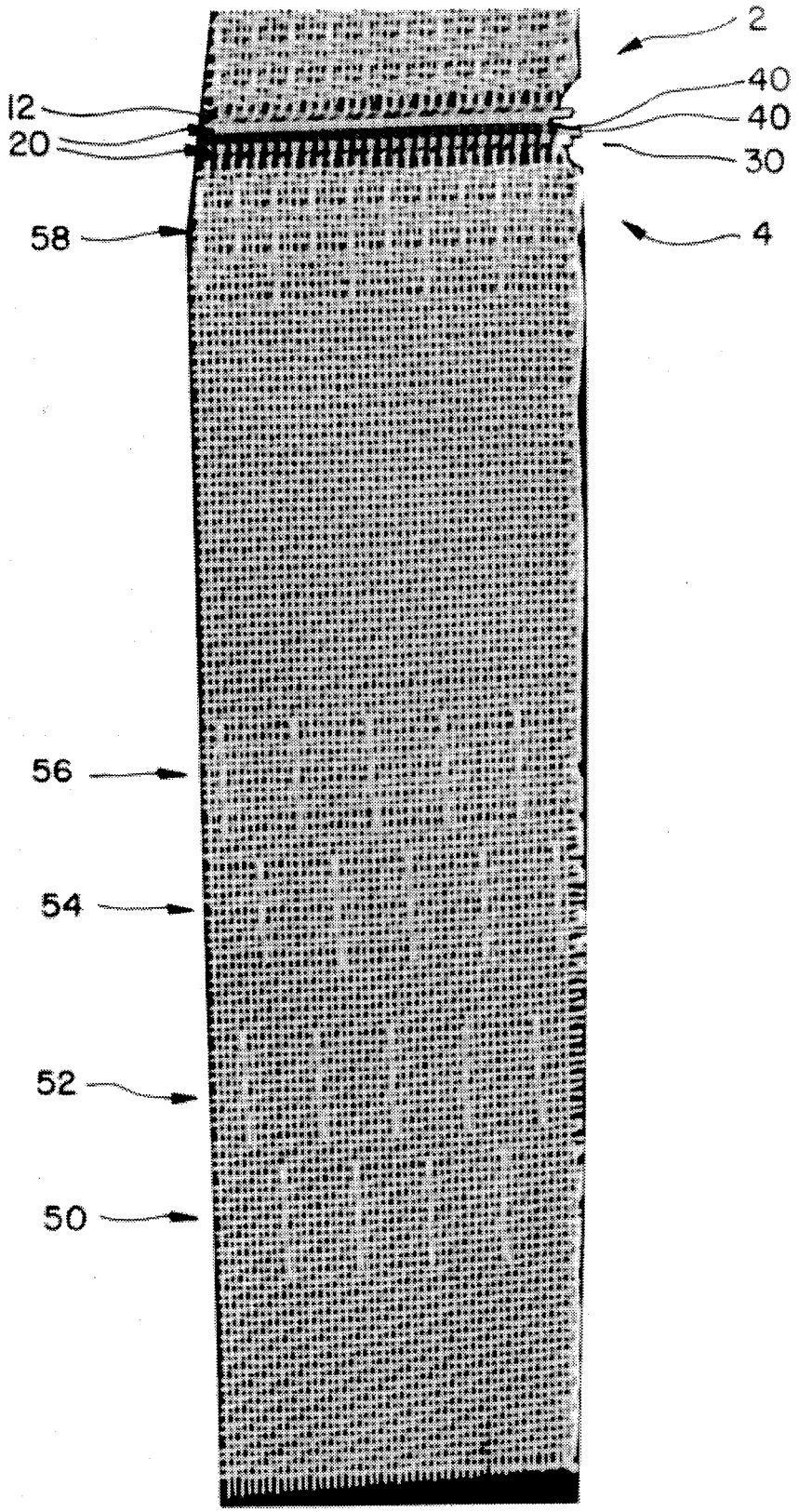
FIG. 5 is a photographic reproduction, in actual size, of a sample cut from an actual trial fabric.
Figure 6:
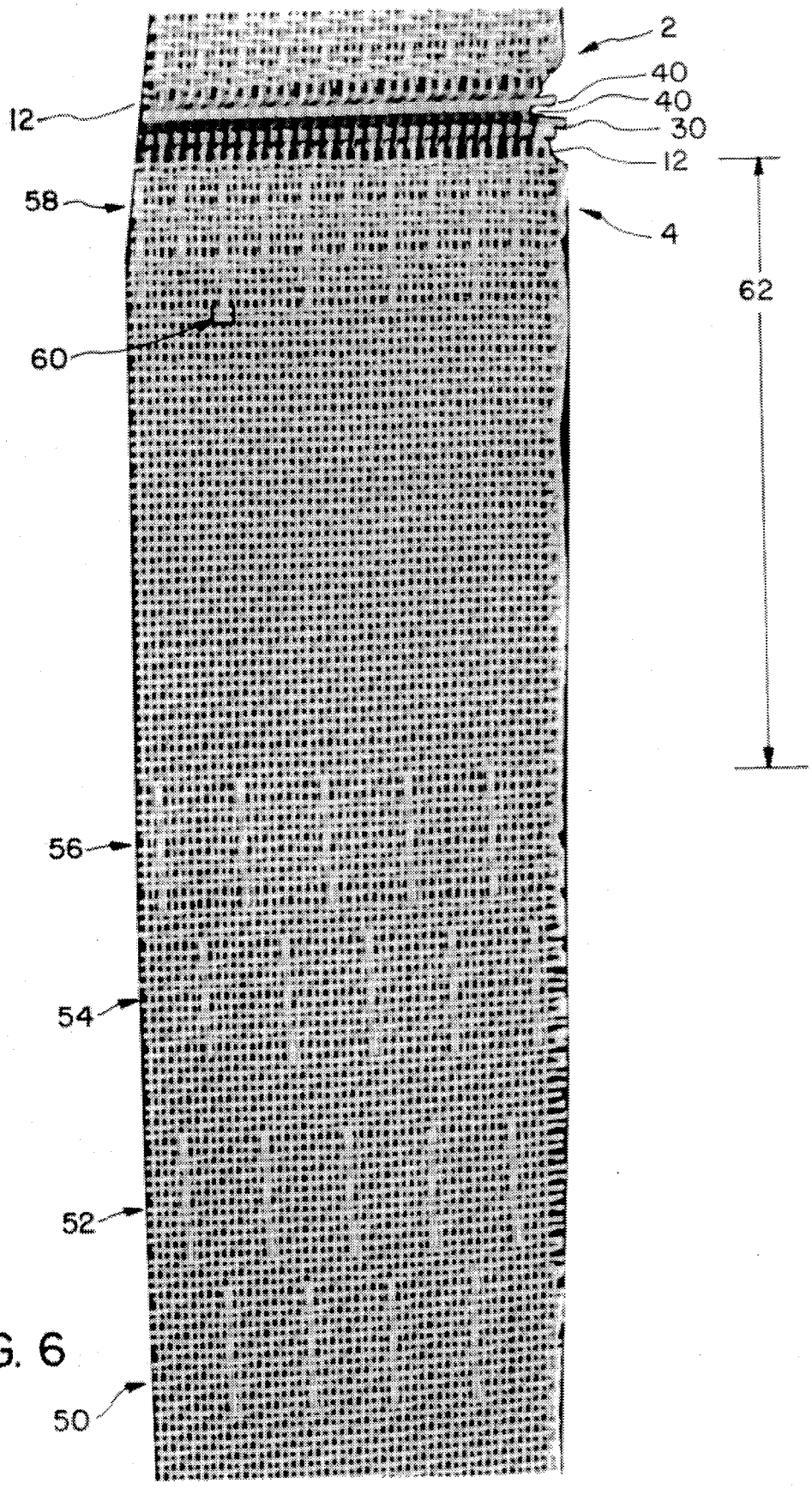
FIG. 6 is a double size photographic reproduction of the seam and lower portion of the sample in FIG. 5.

With reference to FIGS. 5 and 6, the construction of the seam and its impact on fabric uniformity will be explained in more detail. FIG. 5 is an actual size photographic reproduction of a sample cut from an actual trial fabric. FIG. 6 is a double size photographic reproduction of the seam and lower portion of the fabric shown in FIG. 5. As can be seen from FIGS. 5 and 6, a five shed weave pattern having "(n–1)÷2" yarns backwoven in accordance with the prior art techniques will produce a number of areas 52 through 56 where adjacent machine direction yarns are running in parallel for a short distance. As is known in the art, it is preferred that the parallel yarns be spaced throughout the fabric and this portion of the fabric is consistent with the prior art. With particular reference to FIG. 6, it can be seen that the "$n^{th}$" yarn backwoven in area 58 is not in keeping with the prior art. In accordance with the present invention, the "$n^{th}$" yarn in each repeat passes around the tying wire 12 and the head curve 16 and is then woven back into the fabric in precisely its same weave , pattern. As illustrated by the bracket 60, the "$n^{th}$" yarn appears to be twinned with itself in the same manner as appears in areas 50 through 56. However, no yarns have been removed in the area 58 in order to accommodate the backweaving of the "$n^{th}$" yarn. As can be seen from examination of the fabric between the areas 56 and 58, the prior art practice of removing a yarn in the adjacent shed together with the backweaving of the looping yarn in that pattern results in a fabric having an identical weave pattern throughout the body portion between the seam and the area 56. While it has been suggested in the prior art to have the backwoven yarn and the previously trimmed yarn terminate in adjoining butts, it is generally preferred that the yarns extend beyond each other for some minimum distance in order to prevent unraveling. Still with reference to FIG. 6, it can be seen that the "$n^{th}$" yarn is backwoven for a length that is substantially shorter than the backwoven length of the other yarns. The distance between the seam and the next nearest area of backwoven yarns 56, illustrated as 62, is three to four times greater than the distance for which the "$n^{th}$" yarns are backwoven. The presence of the backwoven area 58 is a distinguished characteristic of the present seam.

With respect to the identification of an acceptable seam mark, reference is made to FIGS. 7 through 9. FIG. 7 is a photographic reproduction of a toweling sample wrapped about a small roll. As can be seen from the lighting on that sample, the seam mark is virtually indistinguishable in the lighted area. As you progress around the roll, shadows tend to increase the noticeability of the seam area. With respect to product quality, it has been determined that sheet formation qualities of the bordering portions 62 and 64 compare favorably with the seam area 66. In order to further define the sheet formation characteristics of the seam, a sample of the toweling as shown in FIG. 7, was treated with graphite shavings to highlight the pattern. The sheet formation patterns, in areas 62 and 64, and the seaming pattern in the area 66 are shown in actual size in FIG. 8. The area patterns are shown in double size in FIG. 9. In view of the fact that the sheet formation, quality and product characteristics of the toweling was uniform, the seam marking as illustrated at 66 was deemed to be both minimal and acceptable.

The method of producing a coil seam in accordance with the present invention utilizes known shed formation devices. Before seaming, the fabric is given a preliminary heat setting treatment in order to set the woven condition. The seam is then woven in accordance with the description provided above. After the seam is completed, the fabric is given a final heat set. This is common in the industry. After the fabric has been finally heat set, the fabric then is taken to a seam pressing operation, much like ironing, where just the seam area is subjected to heat, below the melting point of the fabric, and pressure, of about two thousand pounds. Since the preferred coiled material is polyetheretherketone, PEEK, the coil is generally more resistant to heat than the material of the host fabric. As a result, the coil is not damaged by this operation. However, it has been found that pressing under pressure tends to produce more uniform knuckles in the seam area where the yarns pass around the coil before the pattern repeats. While seam pressing is not required in all applications, it is believed that seam pressing does improve seam mark and characteristics.

As can be seen from the above, the present invention provides a practical means for terminating single layer fabrics woven in uneven shed patterns. In addition, the present invention provides seam strength characteristics which are consistent with the strength, running endurability characteristics required of the fabric while producing product thereon which satisfies the product quality characteristics with minimal seam marking.

We claim:

1. A seam construction joining opposite ends of a woven industrial fabric, said fabric having machine direction and cross machine direction yarns interwoven in a pattern that defines a single layer fabric body extending between the ends thereof; the machine direction yarns at each end define a series of loops that extend from the fabric body and secure a coil seam member to each end thereof such that the coil seam members intermesh and define a pintle channel into which a pintle is inserted to close the fabric seam and form an endless papermaker's fabric, the machine direction yarns are woven in the fabric body in a repeated pattern having "n" yarns, wherein "n" is an uneven number and "(n–1)÷2" yarns pass around the respective coil member and are woven back into the body of the fabric in a shed pattern defined by a removed machine direction yarn; and the "$n^{th}$" yarn passes around the respective coil member and is woven back into the body of the fabric in its identical shed pattern, whereby the "$n^{th}$" yarn is twinned with itself.

2. A seam construction joining opposite ends of an industrial fabric having a predetermined caliper, said fabric having machine direction and cross machine direction yarns interwoven in an uneven shed pattern that defines a single layer fabric body extending between the ends thereof; the machine direction yarns at each end define a series of loops that extend from the fabric body and secure a coil seam member to each end thereof such that the coil seam members intermesh and define a pintle channel into which a pintle is inserted to close the fabric seam and form an endless fabric, the machine direction yarns are woven in a repeated pattern having "n" yarns, wherein "n" is an uneven number and "(n–1)÷2" yarns are woven back into the body of the fabric in a shed pattern defined by a removed machine direction yarn and the "$n^{th}$" yarn is woven back into the body of the fabric in its identical shed pattern and is twinned with itself.

* * * * *